US008589058B2

(12) United States Patent
Yuasa

(10) Patent No.: US 8,589,058 B2
(45) Date of Patent: Nov. 19, 2013

(54) METHOD OF RETRIEVING INFORMATION FOR A MOTOR VEHICLE

(75) Inventor: Go Yuasa, Rancho Palos Verdes, CA (US)

(73) Assignee: Honda Motor Co., Ltd., Tokyo (JP)

( * ) Notice: Subject to any disclaimer, the term of this patent is extended or adjusted under 35 U.S.C. 154(b) by 127 days.

(21) Appl. No.: 12/943,342

(22) Filed: Nov. 10, 2010

(65) Prior Publication Data

US 2012/0116659 A1 May 10, 2012

(51) Int. Cl.
*G06G 7/76* (2006.01)

(52) U.S. Cl.
USPC ..... 701/117; 701/118; 701/119; 701/532; 701/533; 701/540; 340/905; 340/995.12; 340/995.13; 370/336; 370/338

(58) Field of Classification Search
None
See application file for complete search history.

(56) References Cited

U.S. PATENT DOCUMENTS

| | | | | |
|---|---|---|---|---|
| 6,073,075 | A | 6/2000 | Kondou et al. | |
| 6,356,838 | B1 * | 3/2002 | Paul | 701/410 |
| 6,434,479 | B1 | 8/2002 | Kondou et al. | |
| 6,697,730 | B2 * | 2/2004 | Dickerson | 701/465 |
| 6,882,933 | B2 | 4/2005 | Kondou et al. | |
| 7,116,245 | B1 * | 10/2006 | Bachelder | 340/906 |
| 7,176,813 | B2 | 2/2007 | Kawamata et al. | |
| 7,289,039 | B2 | 10/2007 | Kato et al. | |
| 7,439,878 | B2 | 10/2008 | Kato et al. | |
| 7,518,533 | B2 | 4/2009 | Mafune | |
| 7,526,367 | B2 * | 4/2009 | Schofield et al. | 701/1 |
| 7,747,291 | B2 * | 6/2010 | Himmelstein | 455/569.2 |
| 8,392,367 | B2 * | 3/2013 | Moribe et al. | 707/634 |
| 2003/0065738 | A1 * | 4/2003 | Yang et al. | 709/215 |
| 2003/0225516 | A1 * | 12/2003 | DeKock et al. | 701/214 |
| 2004/0193420 | A1 * | 9/2004 | Kennewick et al. | 704/257 |
| 2004/0260788 | A1 * | 12/2004 | Miyano et al. | 709/217 |
| 2005/0240340 | A1 | 10/2005 | Ishikawa et al. | |
| 2006/0074546 | A1 * | 4/2006 | DeKock et al. | 701/117 |
| 2006/0287918 | A1 * | 12/2006 | Canaday | 705/14 |
| 2007/0088490 | A1 * | 4/2007 | Sutardja | 701/117 |
| 2007/0159355 | A1 * | 7/2007 | Kelly et al. | 340/905 |
| 2007/0168110 | A1 * | 7/2007 | Jiang et al. | 701/117 |
| 2007/0282959 | A1 * | 12/2007 | Stern | 709/206 |
| 2007/0290839 | A1 * | 12/2007 | Uyeki et al. | 340/539.13 |
| 2008/0002583 | A1 * | 1/2008 | Liu et al. | 370/235 |
| 2008/0002635 | A1 * | 1/2008 | Mosko et al. | 370/338 |
| 2008/0004791 | A1 | 1/2008 | Sera | |
| 2008/0039113 | A1 * | 2/2008 | Liu et al. | 455/456.1 |
| 2008/0071465 | A1 * | 3/2008 | Chapman et al. | 701/117 |
| 2008/0077314 | A1 * | 3/2008 | Ishikawa | 701/117 |
| 2008/0091339 | A1 | 4/2008 | Nagase et al. | |

(Continued)

OTHER PUBLICATIONS

International Search Report mailed Feb. 2, 2012 in PCT Application No. PCT/US2011/059049.

(Continued)

*Primary Examiner* — Khoi Tran
*Assistant Examiner* — Jonathan L Sample
(74) *Attorney, Agent, or Firm* — Plumsea Law Group, LLC

(57) ABSTRACT

A method of receiving information for a motor vehicle is disclosed. The method includes retrieving stored traffic information from a database and determining a communication period for receiving current traffic information from a service provider based on the stored traffic information. The method also includes receiving current traffic information simultaneously with other non-traffic information when the non-traffic information is being requested in order to limit the number of instances of communication with the service provider.

14 Claims, 10 Drawing Sheets

(56) References Cited

U.S. PATENT DOCUMENTS

| | | | | |
|---|---|---|---|---|
| 2008/0319653 | A1* | 12/2008 | Moshfeghi | 701/208 |
| 2009/0030596 | A1 | 1/2009 | Okude et al. | |
| 2009/0043486 | A1* | 2/2009 | Yang et al. | 701/117 |
| 2009/0118995 | A1* | 5/2009 | Zhao et al. | 701/117 |
| 2009/0157299 | A1 | 6/2009 | Mafune | |
| 2009/0164115 | A1 | 6/2009 | Kosakowski et al. | |
| 2009/0172031 | A1* | 7/2009 | Moribe et al. | 707/104.1 |
| 2009/0210152 | A1* | 8/2009 | Kawa | 701/208 |
| 2010/0023246 | A1* | 1/2010 | Zhao et al. | 701/117 |
| 2010/0036595 | A1* | 2/2010 | Coy et al. | 701/119 |
| 2010/0094532 | A1* | 4/2010 | Vorona | 701/119 |
| 2010/0100310 | A1* | 4/2010 | Eich et al. | 701/201 |
| 2011/0035141 | A1* | 2/2011 | Barker et al. | 701/119 |
| 2011/0082636 | A1* | 4/2011 | Barker et al. | 701/118 |
| 2011/0264361 | A1* | 10/2011 | Stahlin | 701/200 |
| 2012/0069786 | A1* | 3/2012 | Wiatrowski et al. | 370/315 |

OTHER PUBLICATIONS

International Preliminary Report on Patentability mailed May 23, 2013 in International Application No. PCT/US2011/059049.

* cited by examiner

METHOD OF RETRIEVING INFORMATION FOR A MOTOR VEHICLE

BACKGROUND

The embodiments relate generally to a motor vehicle, and in particular to a method of retrieving information for a motor vehicle.

Navigation systems for motor vehicles have been previously proposed. Some navigation systems are configured to communicate with one or more remote systems in order to provide various kinds of real-time information. Systems that provide updated traffic information are used to determine more accurate travel times for a user along a particular route.

The related art lacks provisions for efficiently reducing communication costs associated with obtaining various types of navigation information from a remote source such as a service provider.

SUMMARY

In one aspect, a method of receiving information for a motor vehicle, comprises the steps of: receiving a current location for the motor vehicle; retrieving stored traffic information for the current location from a database; requesting current traffic information from a service provider, the service provider being located outside of the motor vehicle; setting a communication cycle with the service provider to a first communication period when there is a first type of traffic congestion, and setting the communication cycle with the service provider to a second communication period when there is a second type of traffic congestion, the second type of traffic congestion being different than the first type of traffic congestion; and wherein the first communication period is longer than the second communication period.

In another aspect, a method of receiving information for a motor vehicle, comprises the steps of: receiving operating information about one or more systems of the motor vehicle; initiating a communication cycle with a service provider for receiving a first type of information, the communication cycle occurring at a first communication period; determining if a second type of information is being requested from the service provider, the second type of information being different from the first type of information; preventing the first type of information from being retrieved at the first communication period when the second type of information is being requested; and receiving the first type of information with the second type of information.

In another aspect, a method of receiving information for a motor vehicle, comprises the steps of: receiving operating information about one or more systems of the motor vehicle; initiating a communication cycle with a service provider for receiving a first type of information, the communication cycle occurring at a first communication period; retrieving a first time corresponding to the end of the first communication period; determining if a second type of information is being requested from the service provider, the second type of information being different from the first type of information, and wherein the second type of information is scheduled to be received at a second time that is substantially different from the first time; receiving the traffic information at the first time if the first type of information is the only type of information currently being requested; receiving the traffic information at the second time if the second type of information is being requested from the service provider; and thereby receiving the first type of information with the second type of information.

Other systems, methods, features and advantages will be, or will become, apparent to one of ordinary skill in the art upon examination of the following figures and detailed description. It is intended that all such additional systems, methods, features and advantages be included within this description and this summary and be protected by the following claims.

BRIEF DESCRIPTION OF THE DRAWINGS

The exemplary embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
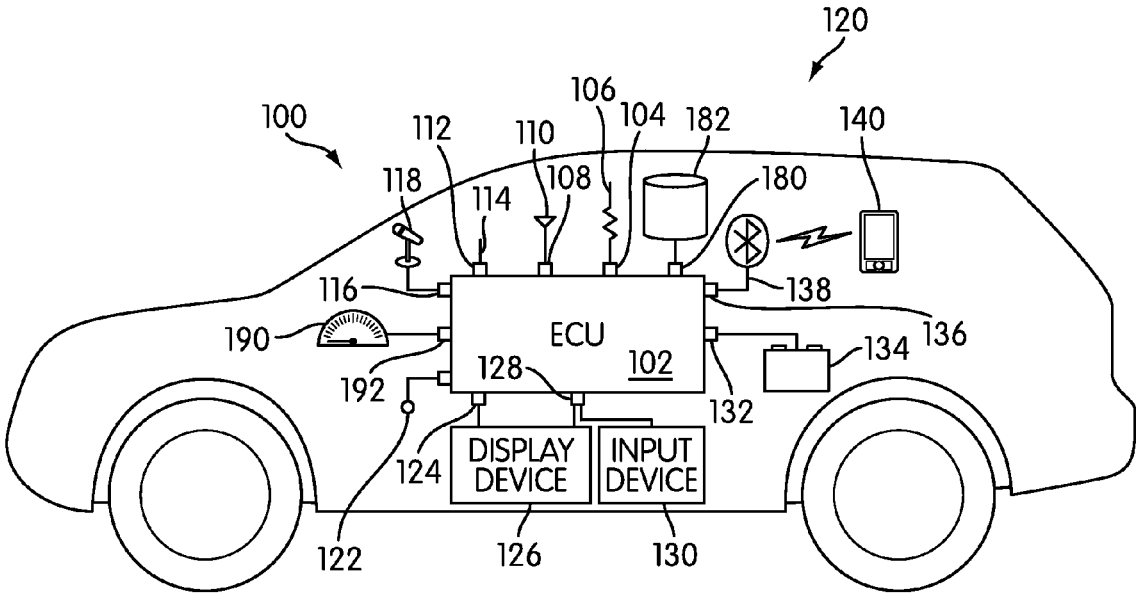
FIG. 1 is a schematic view of an embodiment of various components for a motor vehicle.

FIG. 1 is a schematic view of a system for retrieving information for a motor vehicle. The term "motor vehicle" as used throughout this detailed description and in the claims refers to any moving vehicle that is capable of carrying one or more human occupants and is powered by any form of energy. The term "motor vehicle" includes, but is not limited to: cars, trucks, vans, minivans, SUVs, motorcycles, scooters, boats, personal watercraft, and aircraft.

In some cases, the motor vehicle includes one or more engines. The term "engine" as used throughout the detailed description and claims refers to any device or machine that is capable of converting energy. In some cases, potential energy is converted to kinetic energy. For example, energy conversion can include a situation where the chemical potential energy of a fuel or fuel cell is converted into rotational kinetic energy or where electrical potential energy is converted into rotational kinetic energy. Engines can also include provisions for converting kinetic energy into potential energy. For example, some engines include regenerative braking systems where kinetic energy from a drive train is converted into potential energy. Engines can also include devices that convert solar or nuclear energy into another form of energy. Some examples of engines include, but are not limited to: internal combustion engines, electric motors, solar energy converters, turbines, nuclear power plants, and hybrid systems that combine two or more different types of energy conversion processes.

Referring to FIG. 1, motor vehicle 100 can include various devices. In some embodiments, motor vehicle 100 can include electronic control unit 102, hereby referred to as ECU 102. ECU 102 can include a number of ports that facilitate the input and output of information and power. The term "port" means any interface or shared boundary between two conductors. In some cases, ports can facilitate the insertion and removal of conductors. Examples of these types of ports include mechanical connectors. In other cases, ports are interfaces that generally do not provide easy insertion or removal. Examples of these types of ports include soldering or electron traces on circuit boards.

All of the following ports and provisions associated with ECU 102 are optional. Some embodiments may include a given port or associated provision, while others may exclude it. The following description discloses many of the possible parts and provisions that can be used, however, it should be kept in mind that not every part or provision must be used in a given embodiment. ECU 102 includes a wireless network antenna port 104 that is designed to receive information from a wireless network antenna 106, a GPS antenna port 108 designed to receive information from a GPS antenna 110 and a radio antenna port 112 designed to receive information from a radio antenna 114.

ECU 102 can also include a number of items that facilitate human interaction. To receive vocal information from a user, ECU 102 can include a microphone port 116 that is capable of communicating with a microphone 118. ECU 102 can also include an audio port 120 that is designed to send audio information to one or more speakers 122 or audio devices. In some embodiments, microphone port 116 and audio port 120 are conductors associated with a single physical connector. For example, microphone port 116 and audio port 120 can be female conductors of a multi-channel coaxial plug, like a standard 2.5 mm headset plug.

In order to provide visual information to a user, ECU 102 can include a display port 124 that is capable of interacting with a display device 126. To receive input from a user, ECU 102 can include an input port 128. Input port 128 can communicate with input device 130. In some embodiments, display device 126 can also receive input from a user. In some embodiments, display device 126 includes a touch screen that can receive input and in other embodiments, display device 126 includes a number of buttons that can receive input. In some embodiments, display device 126 includes both a touch screen and buttons. In some cases, user input received by display device 126 can also communicate with input port 128.

A power port 132 can connect ECU 102 to a power supply 134. In the embodiment shown in FIG. 1, power supply 134 is a battery.

ECU 102 can also include provisions to communicate with a wireless telephone. Any system can be used to facilitate this communication with a wireless telephone. In some cases, a low power radio frequency system may be used. In an exemplary embodiment, a wireless local or personal area network using the Bluetooth® protocol is used to facilitate communication with a wireless telephone. In other cases, a wireless local or personal area network can be used employing any IEEE 802.15 protocol. In the exemplary embodiment shown in FIG. 1, ECU 102 includes a local wireless network antenna port 136 that is designed to communicate with a local wireless network antenna 138, which in turn, is designed to communicate wirelessly with wireless telephone 140.

Generally, any type of wireless telephone can be used to communicate with ECU 102. Wireless telephone 140 can be any device capable of sending and receiving calls. In addition, in some cases, wireless telephone 140 may be configured to send and receive data including text messages, emails, as well as other types of data.

In some embodiments, ECU 102 can be configured to receive, store and/or process various types of information. In some embodiments, ECU 102 can be configured to store navigation information. The term "navigation information" refers to any information that can be used to assist in determining a location or providing directions to a location. Some examples of navigation information include street addresses, street names, street or address numbers, apartment or suite numbers, intersection information, points of interest, parks, any political or geographical subdivision including town, township, province, prefecture, city, state, district, ZIP or postal code, and country. Navigation information can also include commercial information including business and restaurant names, commercial districts, shopping centers, and parking facilities. Navigation information can also include geographical information, including information obtained from any Global Navigational Satellite infrastructure (GNSS), including Global Positioning System or Satellite (GPS), Glonass (Russian) and/or Galileo (European). The term "GPS" is used to denote any global navigational satellite system. Additionally, navigation information can include traffic information that may be used for accurately calculating travel times to various locations. Navigation information can include one item of information, as well as a combination of several items of information.

In some embodiments, ECU 102 can include provisions for storing navigation information as well as other types of information. In the current embodiment, ECU 102 may include database port 180 that is configured to communicate with database 182. Database 182 may be any type of database. Database 182 can include any kind of storage device, including but not limited to: magnetic, optical, magneto-optical, and/or memory, including volatile memory and non-volatile memory. In some embodiments, database 182 is integral with ECU 102 and in other embodiments database 182 is separate from ECU 102 and communicates with ECU 102. In some cases, database 182 may be configured to store various types of navigation information. For example, in some cases, database 182 may be configured to store various map information. In an exemplary embodiment, database 182 may be configured to store historical traffic information.

In some embodiments, motor vehicle 100 can include one or more provisions for detecting the vehicle speed of motor vehicle 100. In some cases, motor vehicle 100 can include one or more vehicle speed sensors. In the current embodiment, for example, motor vehicle 100 includes vehicle speed sensor 190, which is in communication with ECU 102 through speed sensing port 192. In some cases, vehicle speed sensor 190 could be one or more wheel speed sensors. In other cases, vehicle speed sensor 190 could be configured to measure the speed of an input or output shaft of a transmission of motor vehicle 100 to determine the vehicle speed. In still other cases, vehicle speed sensor 190 could be any kind of vehicle speed sensor known in the art. In still another embodiments, vehicle speed may be estimated using GPS location information. For example, in one embodiment ECU 102 may detect the position of motor vehicle 100 using information received from GPS antenna 110. In some cases, the position information can be used to determine an approximate speed of motor vehicle 100.

ECU 102 can also include memory, additional data storage provisions including one or more additional databases and/or one or more processors.

In some embodiments, all or most of the items shown in FIG. 1 are housed in a single case or unit. In other embodiments, the various items shown in FIG. 1 are not housed in a single physical case, but instead, are distributed throughout motor vehicle 100 and communicate with one another via known wired or wireless methods. For example, in a system where one or more items communicate wirelessly, the Bluetooth® protocol can be used.

Figure 2:
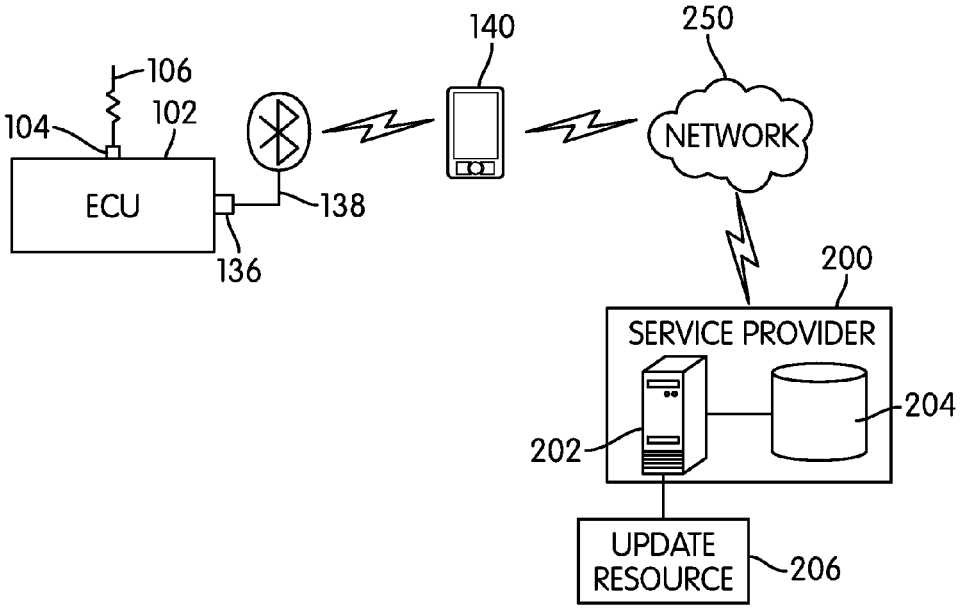
FIG. 2 is a schematic view of an embodiment of a system for communicating between a motor vehicle and a service provider.

Referring now to FIG. 2, ECU 102 may be configured to communicate with a service provider. A service provider may provide various services including navigation based services. In some cases, a service provider may provide map data to a motor vehicle. In other cases, a service provider may provide traffic information to a motor vehicle. In still other cases, a service provider may provide other kinds of information including, but not limited to: weather information, stock price information, point of interest information as well as other kinds of information. In the exemplary embodiment, ECU 102 may communicate with service provider 200.

In some embodiments, service provider 200 can include a computer system 202 and a database 204 in communication with computer system 202. The term "computer system" refers to the computing resources of a single computer, a portion of the computing resources of a single computer, and/or two or more computers in communication with one another, also any of these resources can be operated by one or more human users. In an exemplary embodiment, computer system 202 includes a server.

Computer system 202 may communicate with database 204. Database 204 can include any kind of storage device, including but not limited to: magnetic, optical, magneto-optical, and/or memory, including volatile memory and non-volatile memory. In some embodiments, database 204 is integral with computer system 202 and in other embodiments, database 204 is separate from computer system 202 and communicates with computer system 202. In some embodiments, database 204 is used to store navigation information. In an exemplary embodiment, database 204 includes traffic information. Database 204 can include historical and/or real-time traffic information.

In some embodiments, an update resource 206 is in communication with service provider 200. Update resource 206 can provide updates, revisions, edits and other modifications to service provider 200. In some cases, update resource 206 provides updated navigation information. In some embodiments, update resource 206 provides automated updates. In some embodiments, update resource provides periodic updates.

Motor vehicle 100 can communicate with service provider 200 using wireless network 250. Wireless network 250 can be any kind of wireless network, including but not limited to: any cellular telephone network using, for example, any one of the following standards: CDMA, TDMA, GSM, AMPS, PCS, analog, and/or W-CDMA.

Service provider 200 can communicate with wireless network 250 in a number of different ways. In some embodiments, service provider 200 communicates with wireless network 250 wirelessly. In other embodiments, service provider 200 is directly connected to one or more elements of wireless network 250, and in still other embodiments, service provider 200 communicates with wireless network 250 by using the Internet. In some embodiments, service provider 200 can use more than one method of communicating with wireless network 250 or use other methods as back-ups.

Referring to FIGS. 1 and 2, there are at least two ways in which ECU 102 can communicate with wireless network 250. In some embodiments, ECU 102 includes provisions that permit ECU 102 to act as a wireless telephone. In these embodiments, ECU 102 communicates directly with wireless network 250 and can use wireless network antenna port 104 and wireless network antenna 106 to assist with this communication. In other embodiments, ECU 102 communicates with wireless telephone 140, which in turn, communicates with wireless network 250. In these other embodiments, ECU 102 can use local wireless network antenna port 136 and associated local wireless network antenna 138 to assist in facilitating communications with wireless telephone 140. One or both of these methods can be used by ECU 102 to communicate with wireless network 250.

Figure 3:
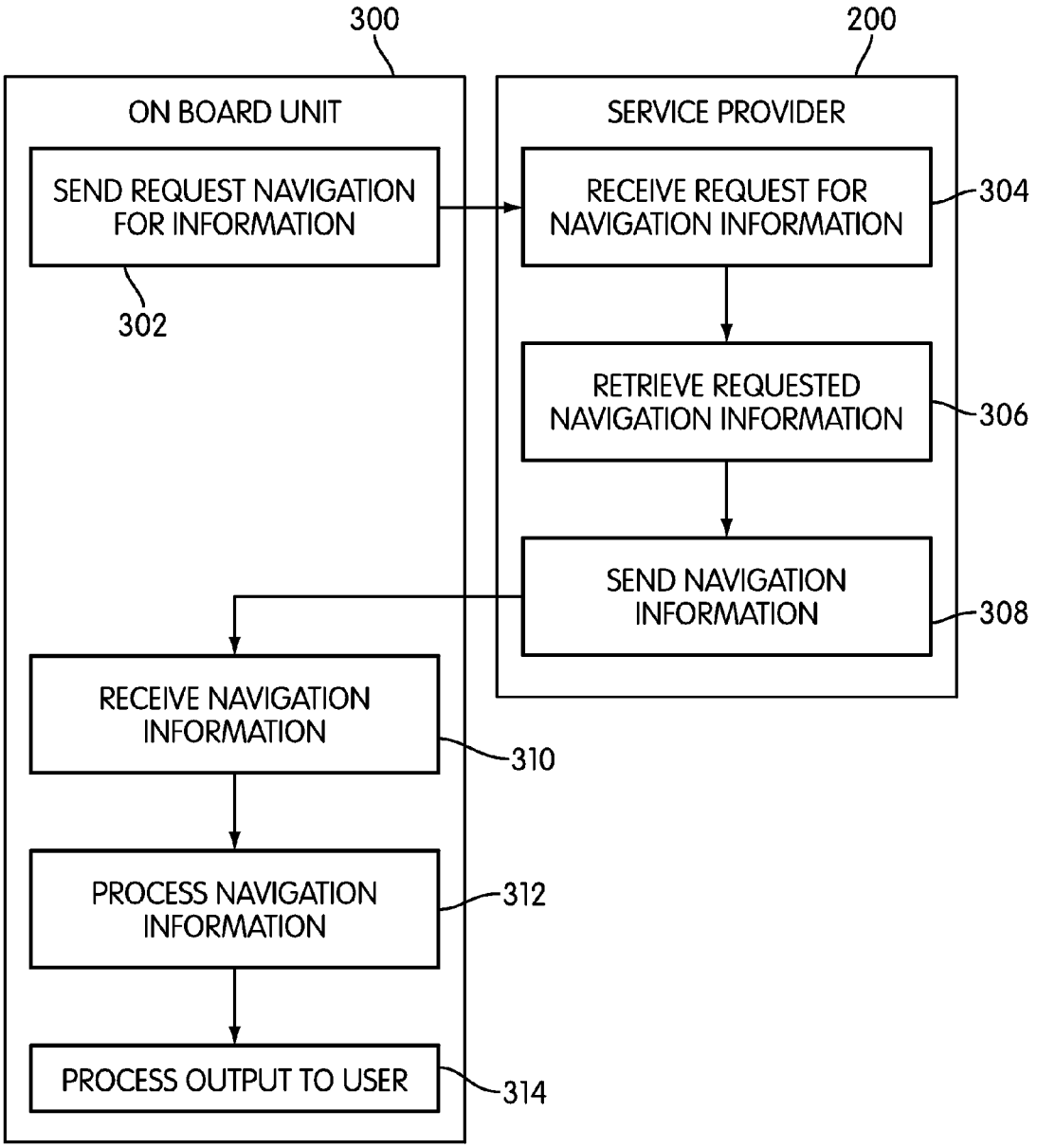
FIG. 3 is an embodiment of a process of retrieving navigation information from a service provider.

Some embodiments provide a system and method managing navigation information. FIG. 3 illustrates an embodiment of a process system for managing navigation information. In the embodiment shown in FIG. 3, certain steps are associated with On-Board Unit (referred to as "OBU") 300 and certain steps are associated with service provider 200. In some embodiments, those steps associated with OBU 300 are performed on or by OBU 300 and those steps associated with service provider 200 are performed on or by service provider 200. However, this is not necessarily the case, and those steps associated with OBU 300 can be performed on or by service provider 200 or some other resource, and those steps associated with service provider 200 can be performed on or by OBU 300 or some other resource. It should also be understood that in some embodiments, one or more of the following steps could be optional. Still further, in other embodiments, additional steps could be added.

OBU 300 is a device or provision associated with motor vehicle 100. In some embodiments, OBU 300 includes provisions that permit OBU 300 to receive information. In some embodiments, OBU 300 can store information in a memory or computer readable media. In some embodiments, OBU 300 includes provisions that permit OBU 300 to process information. In some embodiments, OBU 300 includes provisions that permit OBU 300 to display information. In some embodiments, OBU 300 includes provisions that permit OBU 300 to receive information from a user. In some embodiments, OBU 300 includes provisions that permit OBU 300 to receive information from a wireless network. In some embodiments, OBU 300 includes provisions that permit OBU 300 to interact with a user. In some embodiments, OBU 300 includes a combination of two or more of the above provisions.

Different embodiments can include different elements or features. For simplicity, the term, "On-Board Unit" (OBU) is used to refer to those elements or components that are associated with motor vehicle 100 (see FIG. 1) for a particular embodiment. In an exemplary embodiment, OBU 300 comprises one or more facilities of ECU 102 (see FIG. 1). OBU 300 can also include one or more of the items shown in FIG. 1, for example, ECU 102, display device 126, and/or input device 130.

In some embodiments, as shown in FIG. 3, the process begins when OBU 300 sends a request for navigation information during step 302. The request may be for map data or any other type of navigation information. In an exemplary embodiment, the requested information includes traffic information. In particular, the request may be for real-time, or current, traffic information. In some other embodiments, the request may be for multiple types of navigation information. In other words, the request need not be limited to a single type of navigation information.

Next, during step 304, service provider 200 receives a request for navigation information. Following this, during step 306, service provider 200 may retrieve the requested navigation information. In the exemplary case, service provider 200 may retrieve real time, or updated, traffic information. In some cases, this may be accomplished by accessing traffic information from database 204. In other cases, the traffic information can be retrieved from another resource associated with service provider 200.

During step 308, service provider 200 may send the navigation information back to OBU 300. At step 310, the navigation information is received by OBU 300. Next, during step 312, OBU 300 may process the navigation information. For example, in an embodiment where the navigation information includes traffic information, OBU 300 may associate the traffic information with a map or may use the traffic information to estimate the travel time on a particular route. Following this, during step 314, OBU 300 may process the output for a user. In some cases, this involves displaying a route for a user on display device 126. In other cases, this involves displaying one or more indicia on a map to indicate where traffic congestion is present. In still other cases, an audible sound, alert or message may be used to communicate information to a user.

It will be understood that a similar process can be used for retrieving all different kinds of information that may be requested from a service provider. For example, a similar process can be used to retrieve weather data, stock prices, point of interest information as well as any other kinds of information.

A system for providing navigation information to a user in a motor vehicle can include provisions for saving on communication costs. For example, in embodiments where navigation information, such as traffic information, is provided by a service provider accessed through a wireless telephone, the service provider may charge fees associated with providing the data. In some cases, fees can be charged for each call or message sent. In other cases, fees can be charged for each kilobyte of data transferred. In an exemplary embodiment, a system can include provisions for controlling communication with the service provider in a manner that reduces the communication costs associated with retrieving various types of navigation information, including traffic information.

Figure 4:
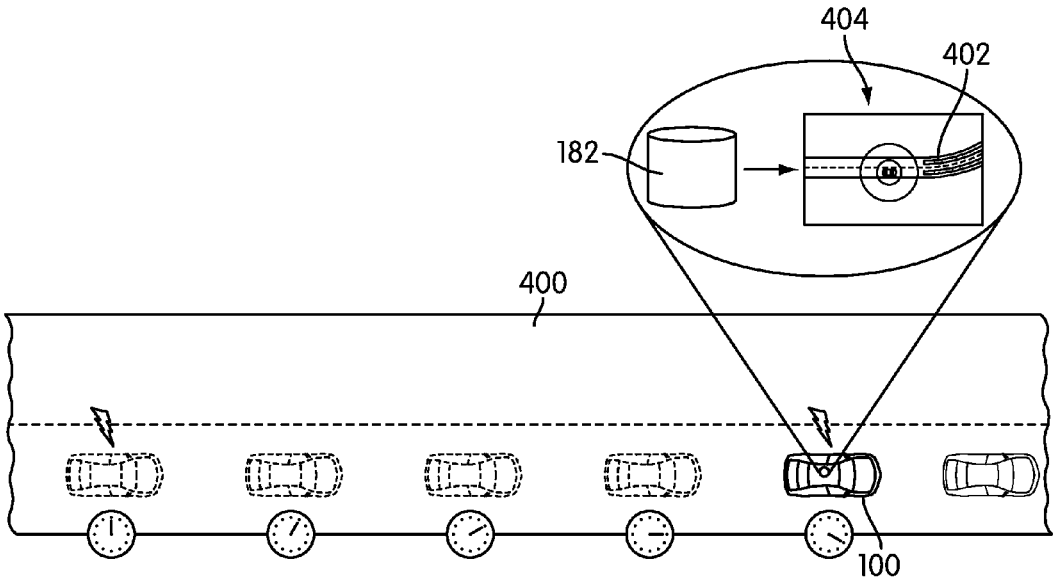
FIG. 4 is a schematic view of an embodiment of a method of communicating with a service provider.
Figure 5:
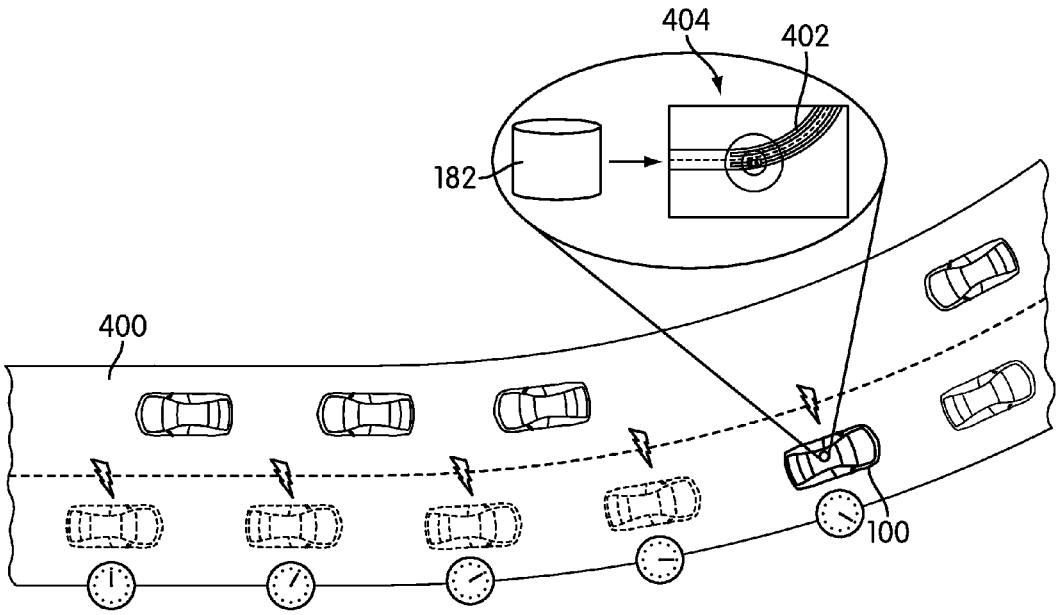
FIG. 5 is a schematic view of an embodiment of a method of communicating with a service provider.

FIGS. 4 and 5 illustrate an exemplary embodiment of a system for controlling communication with a service provider. Referring to FIGS. 4 and 5, motor vehicle 100 is traveling on a section of roadway 400. Motor vehicle 100 has access to database 182. In one embodiment, database 182 may be a local database that is onboard of motor vehicle 100. In another embodiment, database 182 may be a database that is stored at a server. In still another embodiment, motor vehicle 100 may receive information from database 204, which is associated with service provider 200 (see FIG. 2). In some cases, database 182 may include stored traffic information. For purposes of illustration, in the current embodiment stored traffic information 402 is overlaid onto map portion 404. Although the current embodiment illustrates traffic information overlaid onto a portion of a map, it will be understood that in other embodiments traffic information can be stored in any manner. In some cases, traffic information can be stored in one or more tables that are associated with portions of a map.

Stored traffic information 402 can be any kind of traffic information. In some cases, stored traffic information 402 can be real-time traffic information. In other cases, stored traffic information 402 may be historical traffic information that characterizes average traffic behavior in a particular location and at particular times of day. In yet other cases, stored traffic information 402 may be a combination of historical and real-time traffic information.

In an exemplary embodiment, motor vehicle 100 travels through an area with relatively low congestion as determined from stored traffic information 402. In this case, motor vehicle 100 sends a request to a service provider for real-time traffic information at a first communication period. As an example, the first communication period may be approximately 20 minutes. In other words, motor vehicle 100 may send a request for traffic information every 20 minutes. In other words, the frequency of communication may be 3 times an hour.

Referring now to FIG. 5, as motor vehicle 100 travels on a portion of roadway 400 with more traffic congestion, as determined from stored traffic information 402, motor vehicle 100 may begin communicating with a service provider more frequently to obtain more recent traffic information. In this case, motor vehicle 100 sends a request to a service provider for real-time traffic information at a second communication period that is less than the first communication period. As an example, the second communication period may be approximately 5 minutes. In other words, motor vehicle 100 may send a request for traffic information once every five minutes. In other words, the frequency of communication has increased to 12 times an hour.

It will be understood that in other embodiments, the first communication period and the second communication period can vary. For example, in some cases the first communication period can vary in the range between 0 to 180 minutes. In other cases, the first communication period can be greater than 180 minutes. In still other cases, the first communication period can vary in the range between 0 and 60 minutes. Likewise, in some cases the second communication period can vary in the range between 0 and 180 minutes. In other cases, the second communication period can be greater than 180 minutes. In still other cases, the second communication period can vary in the range between 0 and 30 minutes. In still other cases, the second communication period can vary in the range between 0 and 15 minutes. Moreover, it will be understood that in some embodiments the first communication period is selected to be greater than the second communication period.

In the embodiment described above, the motor vehicle uses two different communication periods corresponding to low traffic congestion and high traffic congestion, respectively. In other embodiments more than two communication periods could be used. For example, in some cases, three or more communication periods could be used in regions of low, medium and high congestion, respectively. In still other cases, the communication period could vary continuously according to an associated continuous parameter that characterizes the level of traffic congestion.

In different embodiments, the communication period can vary according to different ways of characterizing congestion. For purposes of clarity, the term "type of congestion" as used throughout this detailed description and in the claims refers to any kind of characterization of traffic congestion. In some cases, type of congestion can refer to volume or amount of traffic congestion. This may be characterized by a total number of vehicles on a roadway. In other cases, the amount of traffic congestion can be characterized by comparing the actual speed of one or more vehicles with the posted speed or speed limit. For example, if vehicles on a highway are traveling well below a speed limit, the amount of traffic congestion can be characterized as medium or high congestion. Likewise, if vehicles traveling on a highway are traveling above a speed limit, the amount of traffic congestion can be characterized as low congestion or no congestion. Moreover it will be understood that any methods of characterizing or assigning values for levels of traffic congestion known in the art can be used. In some cases, traffic congestion levels can be characterized by delay times associated with the amount of time travel will be reduced compared to travel on the roadway at the speed limit.

In some embodiments, the term "type of traffic congestion" can also be used to characterize the variability of traffic in a given location. For example, some regions such as major highways near cities have highly variable traffic patterns. In such regions, it may be desirable to receive frequent traffic updates since traffic patterns are highly variable and can change quickly. In other words, the communication period can be reduced in such areas. In other regions traffic variability may be very low. In such regions, receiving frequent traffic updates is not necessary and the communication period can be increased to save on communication costs. Using these various characterizations of traffic congestion, communication periods may be changed according to the historical levels of congestion or according to the historical variability of congestion in an area.

Figure 6:
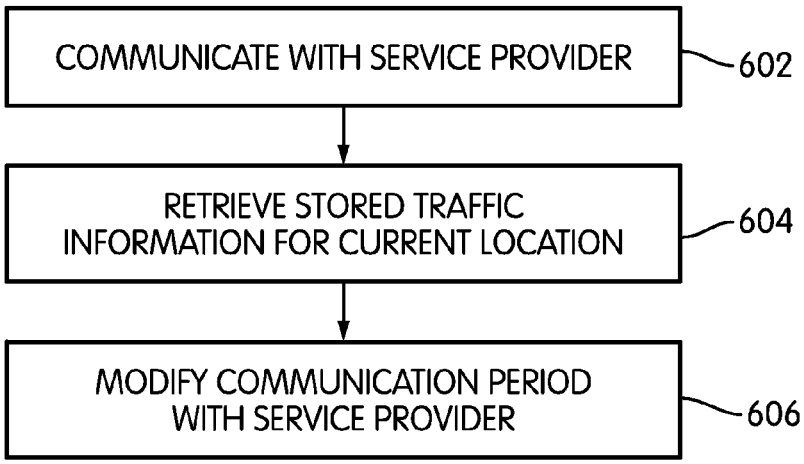
FIG. 6 is an embodiment of a process for managing communication with a service provider.

FIG. 6 illustrates an embodiment of a process system for determining a communication period for traffic information. In the embodiment shown in FIG. 6, certain steps are associated with OBU 300 and certain steps are associated with service provider 200. In some embodiments, those steps associated with OBU 300 are performed on or by OBU 300 and those steps associated with service provider 200 are performed on or by service provider 200. However, this is not necessarily the case, and those steps associated with OBU 300 can be performed on or by service provider 200 or some other resource, and those steps associated with service provider 200 can be performed on or by OBU 300 or some other resource. It should also be understood that in some embodiments, one or more of the following steps could be optional. Still further, in other embodiments, additional steps could be added.

During step 602, OBU 300 may communicate with service provider 200. As previously discussed, this can be accomplished in various different ways in different embodiments. In some cases, OBU 300 and service provider 200 can communicate using a wireless network of some kind. In other cases, OBU 300 and service provider 200 can communicate using one or more wired forms of communication. In an exemplary embodiment, OBU 300 may communicate with a wireless network using a wireless telephone.

Next, during step 604, OBU 300 may retrieve stored traffic information for the current location. In some cases, prior to step 604, OBU 300 may receive a current location from a GPS system, or other type of positioning system. In one embodiment, OBU 300 may retrieve stored traffic information from database 182 or database 204. In some cases, the stored traffic information may be retrieved from an onboard database. In other cases, the stored traffic information may be retrieved from a database associated with a service provider or other remote system. Moreover, the stored traffic information could be real-time traffic information, historical traffic information or a combination of both real-time traffic information and historical traffic information.

It will be understood that in some cases, during step 604, OBU 300 may be configured to detect current traffic conditions based on changes in vehicle speed or other operating parameters. For example, in other cases, OBU 300 may detect traffic information based on current vehicle speed. The current vehicle speed can be detected using a vehicle speed sensor and/or from information related to the location of the vehicle obtained through a GPS system. In particular, if the speed of a vehicle varies greatly in a particular region, or a vehicle travels at a low speed for a substantial period of time, OBU 300 may determine that the vehicle is traveling in a highly congested area.

Following step 604, during step 606, OBU 300 may modify the communication period with a service provider. In other words, OBU 300 may change the frequency of communication with the service provider based on the amount of traffic, or the variation of traffic in the current location.

Figure 7:
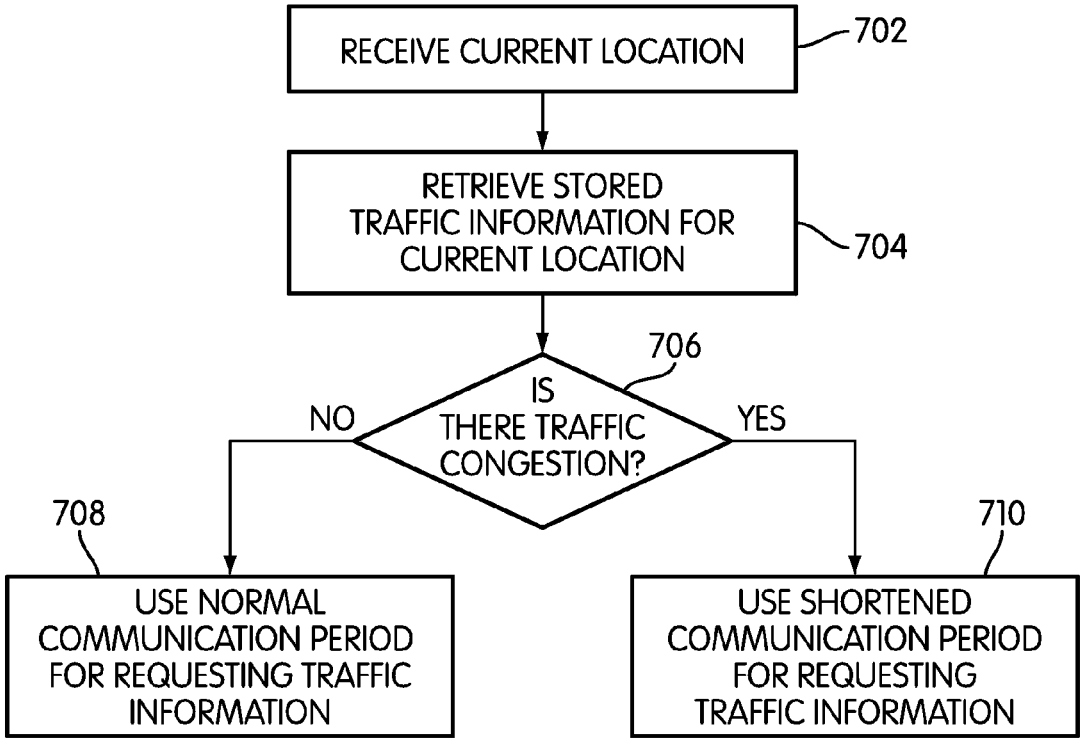
FIG. 7 is an embodiment of a process for managing communication with a service provider.

FIG. 7 illustrates an embodiment of a process system for determining a communication period. In the embodiment shown in FIG. 7, certain steps are associated with OBU 300 and certain steps are associated with service provider 200. In some embodiments, those steps associated with OBU 300 are performed on or by OBU 300 and those steps associated with service provider 200 are performed on or by service provider 200. However, this is not necessarily the case, and those steps associated with OBU 300 can be performed on or by service provider 200 or some other resource, and those steps associated with service provider 200 can be performed on or by OBU 300 or some other resource. It should also be understood that in some embodiments, one or more of the following steps could be optional. Still further, in other embodiments, additional steps could be added.

During step 702, OBU 300 may receive a current location associated with motor vehicle 100. The current location can be determined using GPS information, for example. Next, during step 704, OBU 300 may retrieve stored traffic information for the current location. In some cases, the stored traffic information may be retrieved from an onboard database. In other cases, the stored traffic information may be retrieved from a database associated with a service provider or other remote system. This stored traffic information can be retrieved from database 182 or database 204, for example. In some cases, the stored traffic information can also be determined as a function of date and/or time as well as location. Moreover, the stored traffic information could be real-time traffic information, historical traffic information or a combination of both real-time traffic information and historical traffic information.

Following step 704, during step 706, OBU 300 may determine if there is any traffic congestion in the current location, as determined using the stored traffic information. It will be understood that the stored traffic information may be historical traffic information that reflects average traffic patterns in a given location and may not coincide with actual traffic conditions at any given moment. However, the stored traffic information may be used to estimate the likelihood of different levels of congestion in a given location and at a given time.

If, during step 706, OBU 300 determines that there is no traffic congestion, OBU 300 proceeds to step 708. During step 708, OBU 300 uses a normal communication period to request real-time, or updated, traffic information from a service provider. If however, during step 706, OBU 300 determines that there is traffic congestion, OBU 300 proceeds to step 710. During step 710, OBU 300 uses a shortened communication period to communicate with a service provider for purposes of requesting traffic information.

It will be understood that step 706 could be implemented in a variety of ways in different embodiments. In some cases, the level of traffic congestion in a particular region or on a particular roadway can be quantified. For example, in some cases, OBU 300 may retrieve stored traffic information for one or more meshes associated with a map portion of the current route. Moreover, OBU 300 may calculate an average amount of traffic within the one or more meshes and compare the average amount of traffic to a threshold value. If the average amount of traffic is less than the threshold value, OBU 300 may determine that there is no traffic congestion. If, however, the average amount of traffic is greater than the threshold value, OBU 300 may determine that there is traffic congestion. Furthermore, it will be understood that step 706 could be implemented in still other ways in other embodiments by assigning a true or false value to a "traffic congestion" parameter according to stored traffic information.

It should also be understood that in some embodiments, during step 706, OBU 300 may check the variability of traffic in the region according to the stored traffic information. For example, in some cases, OBU 300 may determine during step 706 that the traffic patterns in the current location are highly variable and change frequently. In such cases, OBU 300 may proceed to step 710 to use a shortened communication period. If, however, OBU 300 determines that the traffic patterns do not change frequently and there is not traffic congestion in the current location, OBU 300 may proceed to step 708 to use a normal communication period.

Although the current embodiment uses two levels of traffic congestion (no congestion or congestion) that are further associated with two communication periods (normal communication period and shortened communication period), in other embodiments more than two levels of traffic congestion and corresponding communication periods could be used. For example, in another embodiment, traffic congestion could be assigned a value of "low", "medium" or "high". Furthermore, communication periods could be "long", "medium" or "short", corresponding to the low, medium and high levels of traffic congestion, respectively. Moreover, in still other embodiments, traffic congestion could be measured as a continuous variable and the communication period could vary continuously as a function of the traffic congestion. Furthermore, it will be understood that in some cases traffic congestion could also be characterized as "low variability", "medium variability" and "high variability" to correspond to long, medium and short communication periods.

A system can include provisions for updating stored traffic information so that traffic congestion can be estimated more accurately for a given location, date and/or time. In some cases, an onboard database can be updated using retrieved traffic information. In other cases, an onboard database can be updated using sensed traffic information. In one embodiment, an onboard database can be updated using a combination of stored traffic information and sensed traffic information. In yet other cases, an offboard database can be updated using stored traffic information and/or sensed traffic information.

Figure 8:
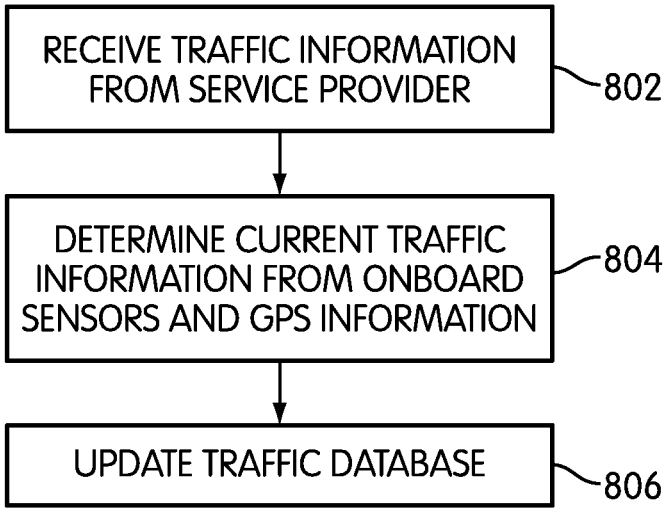
FIG. 8 is an embodiment of a process for updating an onboard database of a motor vehicle.

FIG. 8 illustrates an embodiment of a process system for managing traffic information. In the embodiment shown in FIG. 8, certain steps are associated with OBU 300 and certain steps are associated with service provider 200. In some embodiments, those steps associated with OBU 300 are performed on or by OBU 300 and those steps associated with service provider 200 are performed on or by service provider 200. However, this is not necessarily the case, and those steps associated with OBU 300 can be performed on or by service provider 200 or some other resource, and those steps associated with service provider 200 can be performed on or by OBU 300 or some other resource. It should also be understood that in some embodiments, one or more of the following steps could be optional. Still further, in other embodiments, additional steps could be added.

During step 802, OBU 300 may receive traffic information from service provider 200. In some cases, the traffic information may be real-time traffic information or near real-time traffic information. Next, during step 804, OBU 300 may determine current traffic information from onboard sensors and GPS information. As an example, a vehicle may estimate current traffic conditions according to vehicle speed, which can be retrieved from a vehicle speed sensor or from GPS information. Following step 804, during step 806, OBU 300 may update database 182 or database 204 with new stored traffic information. In particular, in some cases, OBU 300 may determine new average traffic conditions in one or more locations using a combination of previously stored traffic information and the retrieved or sensed real time traffic information. In embodiments where traffic information is stored at a server and not onboard of a motor vehicle, the updated traffic information can be sent to the server. In some cases, a motor vehicle may only send sensed traffic information to a server, which may update a traffic database using the sensed traffic information as well as any other real-time traffic information available to the server.

An onboard unit can include provisions for retrieving traffic information simultaneously with other types of information. For example, in some embodiments, an onboard unit may change the communication period for receiving traffic information to coincide with communication with a service provider to retrieve other types of information including, but not limited to: weather information, stock information, point of interest information as well as other kinds of information.

Figure 9:
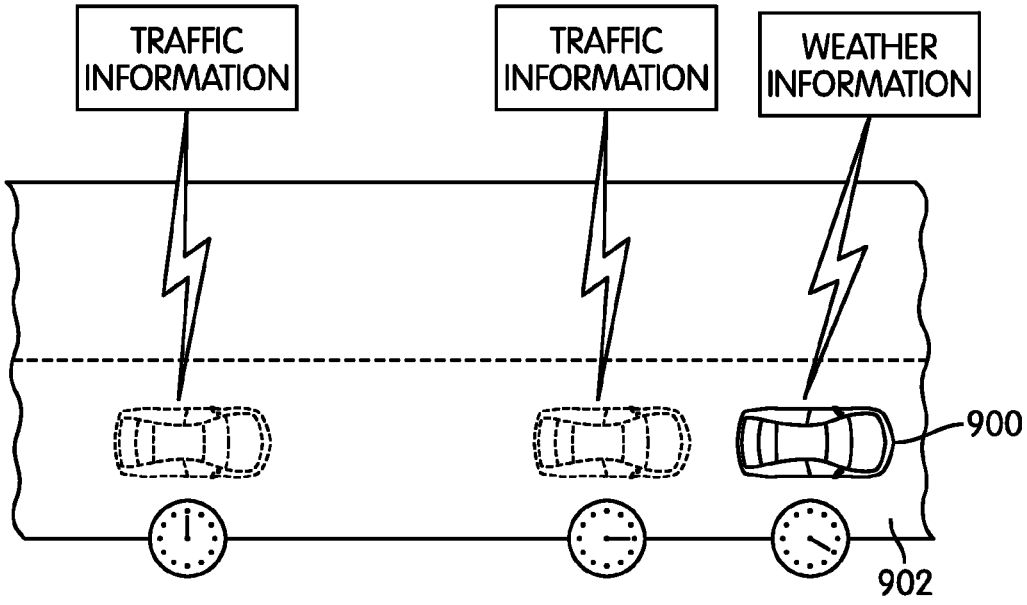
FIG. 9 is an embodiment of a method of communicating with a service provider, in which traffic information and weather information are received separately.

FIG. 9 illustrates an embodiment of a method for communicating with a service provider to obtain different types of information. Referring to FIG. 9, motor vehicle 900 is traveling on roadway 902. In this case, motor vehicle 900 receives traffic information at a predetermined communication period. For example, the predetermined communication period could be approximately 15 minutes. In addition, motor vehicle 900 receives weather information as well. Due to the difference in communication times for receiving traffic information and weather information, motor vehicle 900 must communicate with a service provider at different times for each request of traffic information and for weather information. Over the course of the period shown in FIG. 9, motor vehicle 900 communicates with a service provider three different times. In some situations, each instance of communication may cost a user additional fees associated with charges for transmitting data over a wireless telephone.

Figure 10:
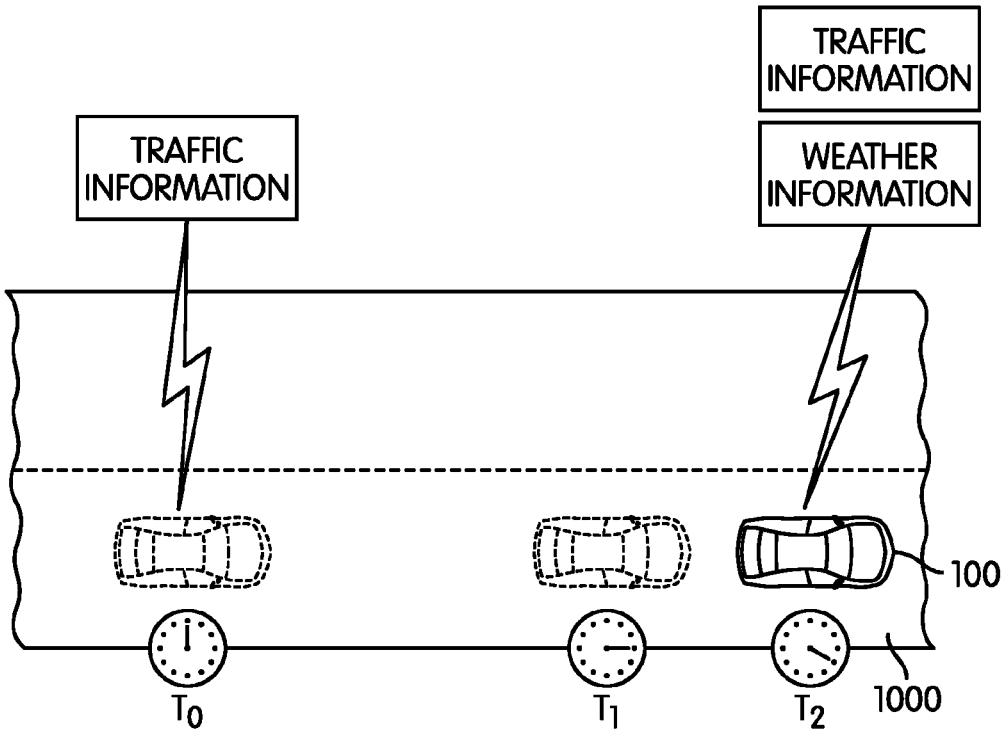
FIG. 10 is an embodiment of a method of communicating with a service provider, in which traffic information and weather information are received together.

FIG. 10 illustrates an embodiment of a method for controlling the communication of a motor vehicle with a service provider to obtain traffic information. Referring to FIG. 10, motor vehicle 100 is traveling on roadway 1000. In this case, motor vehicle 100 is initially configured to request traffic information from a service provider at a first communication period. In one embodiment, the communication period could be approximately 15 minutes. In other words, motor vehicle 100 may communicate with, and receive traffic information from, service provider 200 approximately every 15 minutes. In addition, one or more systems of motor vehicle 100 are configured to obtain weather information from service provider 200.

In this case, motor vehicle 100 is initially configured to request traffic information at time T1, which differs from time T0 by approximately the first communication period of approximately 15 minutes. In addition, motor vehicle 100 is configured to receive weather information at time T2 that occurs just after time T1. In order to reduce total instances of communication with service provider 200, OBU 300 cancels the current communication period for traffic information. Instead, OBU 300 receives the traffic information simultaneously with the weather information at time T2. In some embodiments, motor vehicle 100 may resume receiving traffic information at a regular communication period after the traffic information has been received with the weather information.

This arrangement helps to limit the total number of instances of communication between motor vehicle 100 and service provider 200 in order to reduce the total communication costs associated with receiving traffic information. In contrast to the embodiment shown in FIG. 9, for a period corresponding to approximately 20 minutes, motor vehicle 100 communicates with service provider 200 two different times, rather than three times in the previous example. By consolidating requests for traffic information with requests for other types of information, total communication costs for a user can be substantially reduced.

In the embodiment shown in FIGS. 9 and 10, the time for updating traffic information is delayed (or moved forward) to correspond to the time at which weather information is retrieved. In other cases, it will be understood that a system could include provisions for updating traffic information at an earlier time to correspond to a time when other non-traffic information (such as weather) is retrieved.

Figure 11:
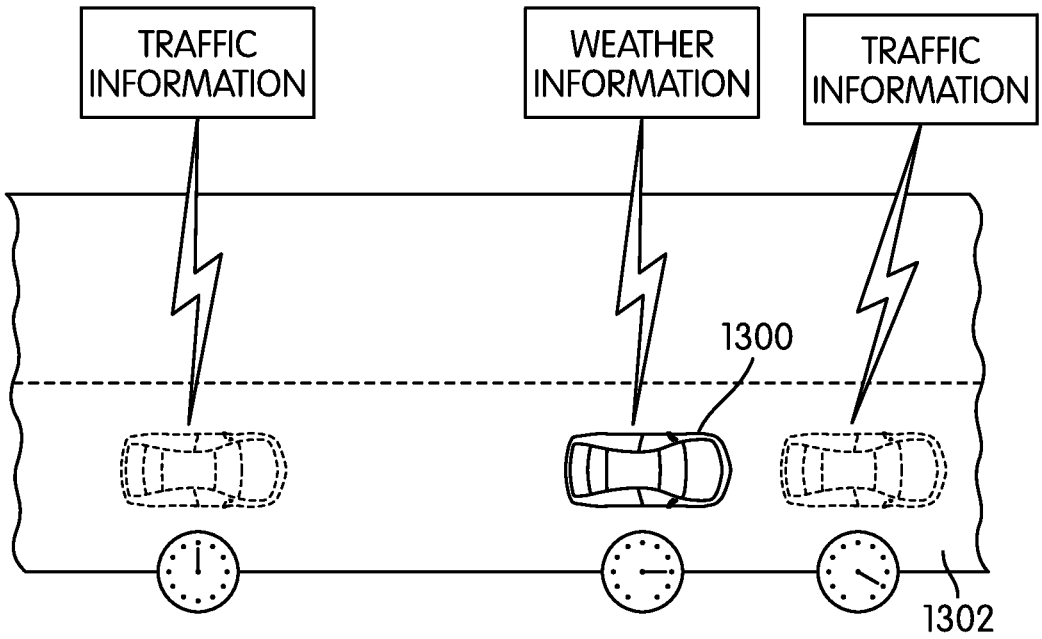
FIG. 11 is an embodiment of a method of communicating with a service provider, in which traffic information and weather information are received separately.
Figure 12:
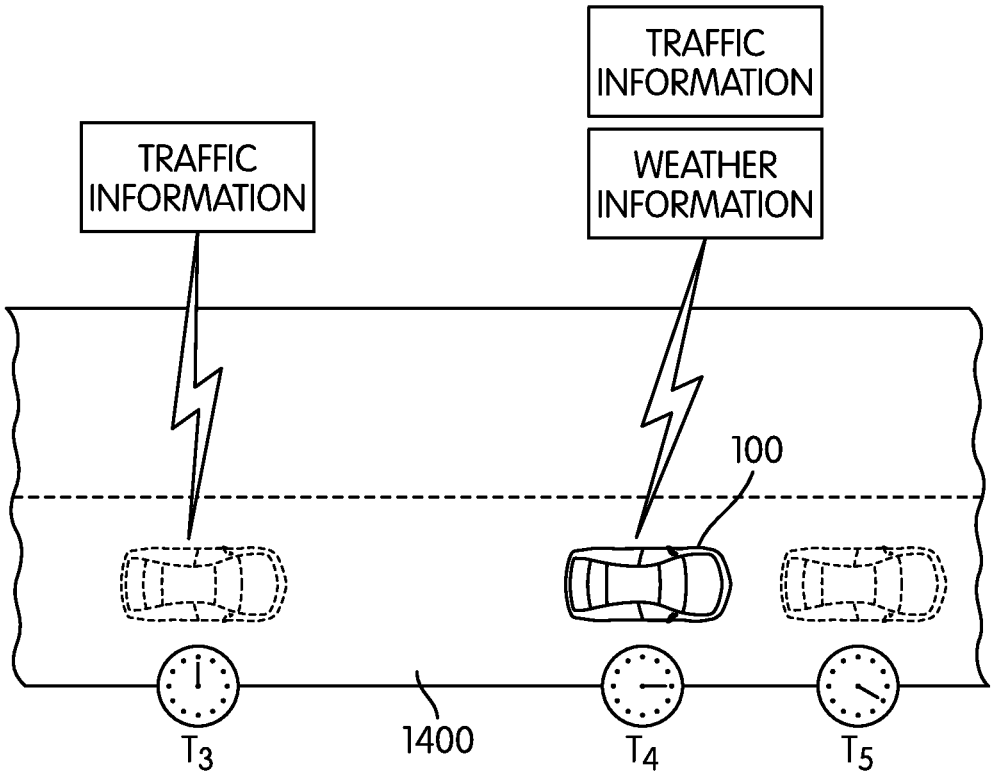
FIG. 12 is an embodiment of a method of communication with a service provider, in which traffic information and weather information are received together.

FIGS. 11 and 12 illustrate another embodiment of a method for communicating with a service provider to obtain different types of information. Referring to FIG. 11, motor vehicle 1300 is traveling on roadway 1302. In this case, motor vehicle 1300 receives traffic information at a predetermined communication period. For example, the predetermined communication period could be approximately 20 minutes. In addition, motor vehicle 1300 receives weather information as well. Due to the difference in communication times for receiving traffic information and weather information, motor vehicle 1300 must communicate with a service provider at different times for each request of traffic information and for weather information. Over the course of the period shown in FIG. 11, motor vehicle 1300 communicates with a service provider three different times. In some situations, each instance of communication may cost a user additional fees associated with charges for transmitting data over a wireless telephone.

FIG. 12 illustrates an embodiment of a method for controlling the communication of a motor vehicle with a service provider to obtain traffic information. Referring to FIG. 12, motor vehicle 100 is traveling on roadway 1400. In this case, motor vehicle 100 is initially configured to request traffic information from a service provider at a first communication period. In one embodiment, the communication period could be approximately 20 minutes. In other words, motor vehicle 100 may communicate with, and receive traffic information from, service provider 200 (see FIG. 2) approximately every 20 minutes. In addition, one or more systems of motor vehicle 100 are configured to obtain weather information from service provider 200.

In this case, motor vehicle 100 is initially configured to request traffic information at time T5, which differs from time T3 by the first communication period of approximately 20 minutes. In addition, motor vehicle 100 is configured to receive weather information at time T4 that occurs just before time T5 (and approximately 15 minutes after T3). In order to reduce total instances of communication with service provider 200, OBU 300 cancels the current communication period for traffic information. Instead, OBU 300 receives the traffic information simultaneously with the weather information at time T4. In other words, OBU 300 updates the traffic information at an earlier time T4 than the scheduled update time T5, so that the weather information and the traffic information can be received substantially simultaneously. In some embodiments, motor vehicle 100 may resume receiving traffic information at a regular communication period after the traffic information has been received with the weather information.

This arrangement helps to limit the total number of instances of communication between motor vehicle 100 and service provider 200 in order to reduce the total communication costs associated with receiving traffic information. In contrast to the embodiment shown in FIG. 11, for a period corresponding to approximately 20 minutes, motor vehicle 100 communicates with service provider 200 two different times, rather than three times in the previous example. By consolidating requests for traffic information with requests for other types of information, total communication costs for a user can be substantially reduced.

Although the current embodiment illustrates an example in which traffic information and weather information are received, the method discussed here could also be applied in situations where any two or more different types of information are received by one or more systems of a motor vehicle. In other words, this method may be applied anytime a first type of information and a second type of information are being requested, especially when the first type of information is initially requested at a regular communication period.

Figure 13:
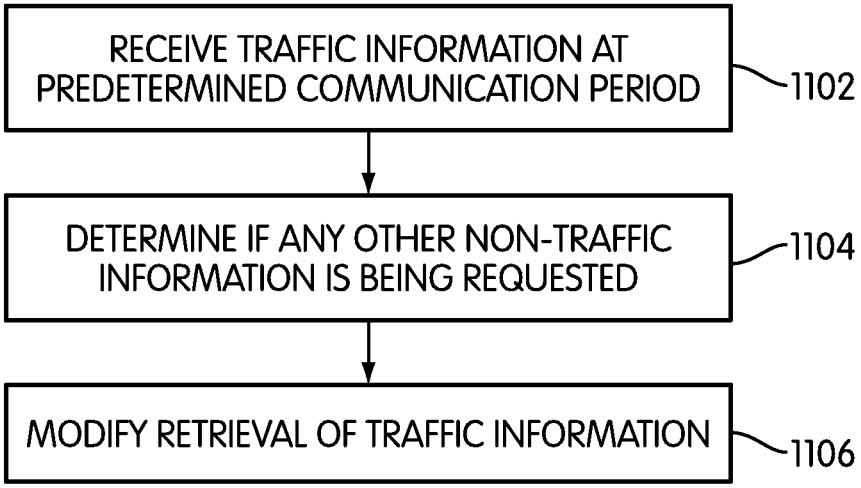
FIG. 13 is an embodiment of a process for managing of communication with a service provider.

FIG. 13 illustrates an embodiment of a process system for updating various kinds of information. In the embodiment shown in FIG. 13, certain steps are associated with OBU 300 and certain steps are associated with service provider 200. In some embodiments, those steps associated with OBU 300 are performed on or by OBU 300 and those steps associated with service provider 200 are performed on or by service provider 200. However, this is not necessarily the case, and those steps associated with OBU 300 can be performed on or by service provider 200 or some other resource, and those steps associated with service provider 200 can be performed on or by OBU 300 or some other resource. It should also be understood that in some embodiments, one or more of the following steps could be optional. Still further, in other embodiments, additional steps could be added.

During step 1102, OBU 300 may receive traffic information at a predetermined communication period. Generally, the predetermined communication period can have any value. In some embodiments, the predetermined communication period can have a value in the range between 0 and 120 minutes. In other embodiments, the predetermined communication period can have a value in the range between 0 and 30 minutes. In still other embodiments, the predetermined communication period can have a value in the range between 0 and 10 minutes. In some cases, the value of the regular communication period could vary according to one or more parameters such as stored traffic information or sensed traffic information.

Next, during step 1104, OBU 300 may determine if any other non-traffic information is being requested by a user or any system of motor vehicle 100. In some cases, OBU 300 may communicate with service provider 200 to receive other types of information that are distinct from traffic information. In other cases, other systems of motor vehicle 100 may communicate with service provider 200 to receive other types of non-traffic information.

During step 1106, OBU 300 may modify the retrieval of traffic information. In particular, in situations where other types of non-traffic information is being requested from service provider 200, OBU 300 may operate in a manner so that traffic information is received substantially simultaneously with one or more other kinds of information including, but not limited to: weather information, stock information, point of interest information as well as other kinds of information.

Figure 14:
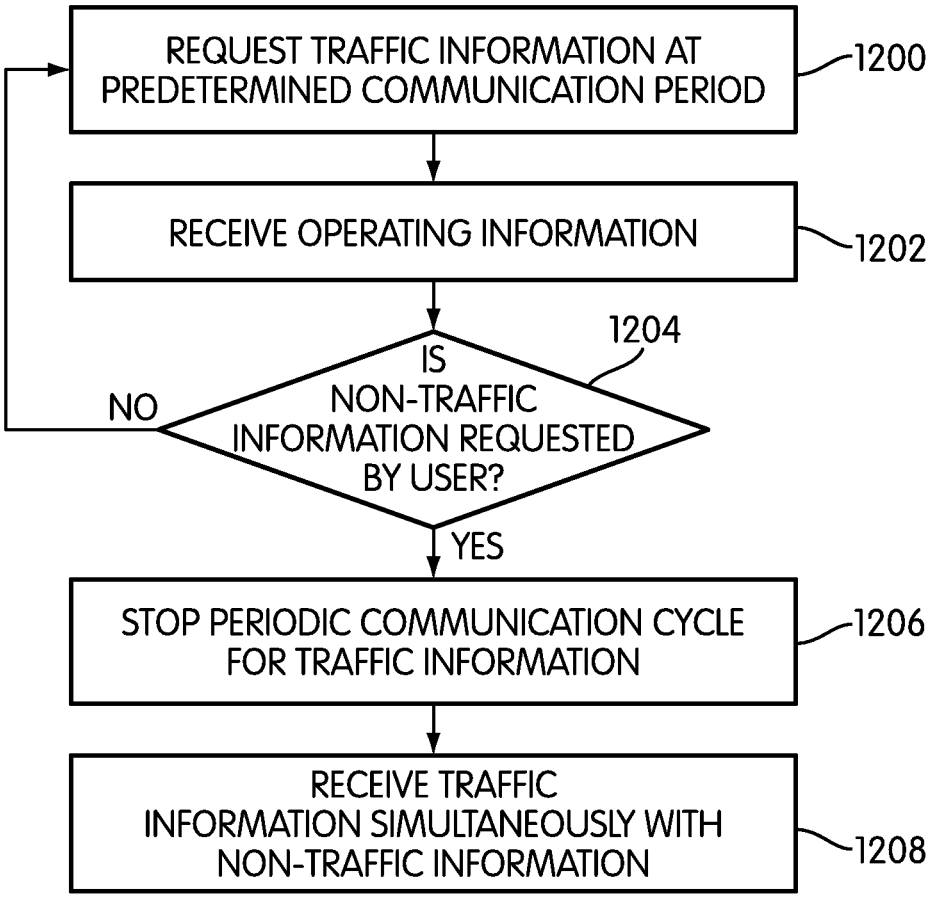
FIG. 14 is an embodiment of a process for managing communication with a service provider.

FIG. 14 illustrates an embodiment of a process system for updating various kinds of information. In the embodiment shown in FIG. 14, certain steps are associated with OBU 300 and certain steps are associated with service provider 200. In some embodiments, those steps associated with OBU 300 are performed on or by OBU 300 and those steps associated with service provider 200 are performed on or by service provider 200. However, this is not necessarily the case, and those steps associated with OBU 300 can be performed on or by service provider 200 or some other resource, and those steps associated with service provider 200 can be performed on or by OBU 300 or some other resource. It should also be understood that in some embodiments, one or more of the following steps could be optional. Still further, in other embodiments, additional steps could be added.

During step 1200, OBU 300 may request traffic information at a regular or predetermined communication period. The length of the communication period can have any value. In some cases, the length of the communication period can be fixed. In other cases, the length of the communication period can vary according to stored traffic information or sensed traffic information, as discussed in detail above.

During step 1202, OBU 300 receives operating information. The term "operating information" as used throughout this detailed description and in the claims refers to information related to any systems, devices or components useful in the operation of motor vehicle 100. Operation information can include information from OBU 300, or from one or more different systems, devices or components of motor vehicle 100. In some cases, operating information can include the type of information being requested from any system of motor vehicle 100, including any information requested by OBU 300. As an example, if a system of motor vehicle 100 is requesting weather information from a service provider, this information may be designated as operational information.

Following step 1202, during step 1204, OBU 300 may determine if any non-traffic information is being requested by a user or any system of motor vehicle 100. As an example, a user may request weather information by interacting with a touch screen of OBU 300. As another example, a user may request stock prices. As still another example, a user may request information related to one or more points of interest.

If, during step 1204, OBU 300 determines that no other information is being requested, OBU 300 may return back to step 1200 to continue requesting traffic information at a regular communication period. If, however, OBU 300 determines during step 1204 that another kind of information is being requested, OBU 300 may proceed to step 1206.

During step 1206, OBU 300 may stop the periodic communication cycle for receiving traffic information. Next, during step 1208, OBU 300 may receive the traffic information substantially simultaneously with the other, non-traffic information from service provider 200.

Figure 15:
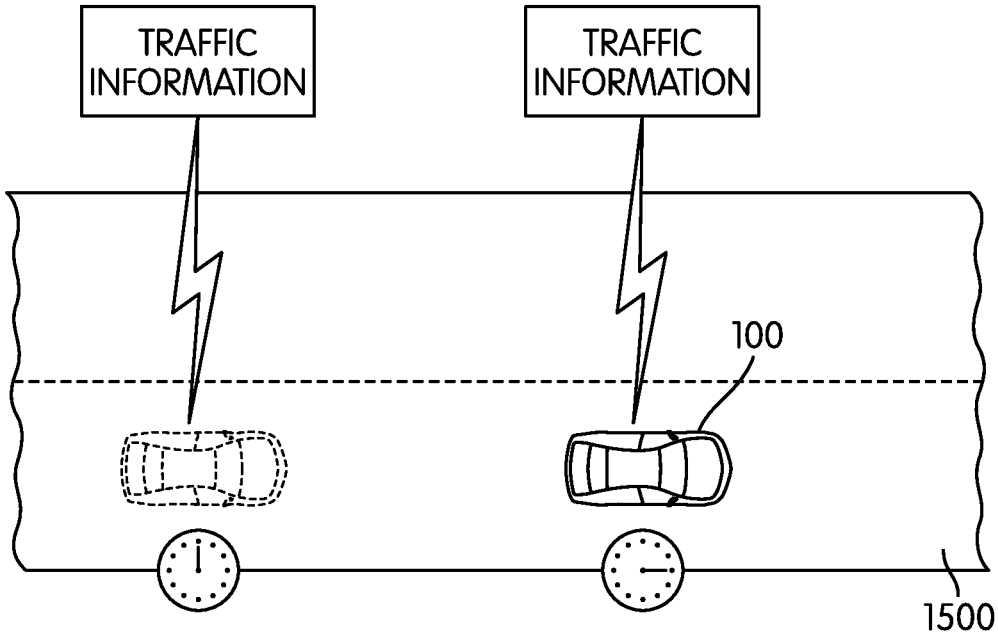
FIG. 15 is another embodiment of a method of communicating with a service provider, in which traffic information is received at regular intervals.
Figure 16:
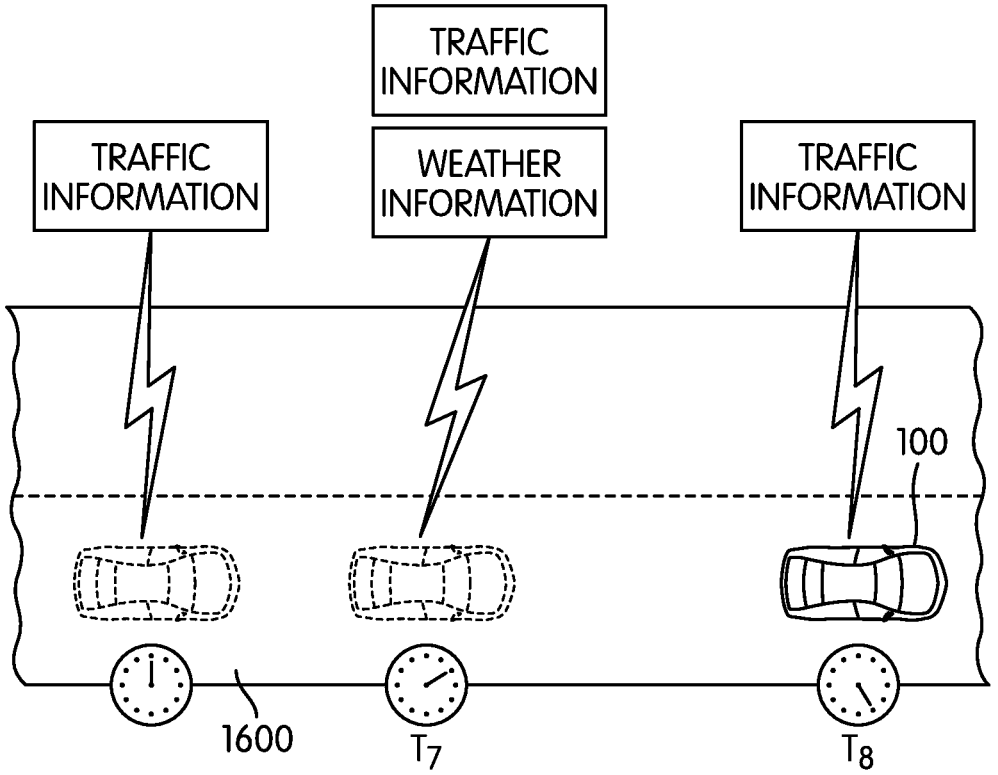
FIG. 16 is an embodiment of a method of communicating with a service provider, in which traffic information is received with weather information and then traffic information is received at regular intervals.

FIGS. 15 and 16 illustrate another embodiment of a method of communicating with a service provider. Referring to FIG. 15, motor vehicle 100 may be configured to communicate traffic information at a predetermined communicated period of approximately 15 minutes. Referring to FIG. 16, when weather information is also being retrieved, the predetermined communication period may be stopped, so that the weather information and the traffic information can be received together. In this case, the weather and traffic information are received approximately 10 minutes after the most recent traffic information update. Once the update of traffic and weather information has been completed, OBU 300 may reset the communication period for updating traffic to the original predetermined communication period. For example, as seen in FIG. 16, following the traffic and weather information update at time T7, the traffic information may be updated once again at time T8. Time T8 may occur approximately 15 minutes after time T7, which corresponds to the predetermined communication period for receiving traffic information updates.

Figure 17:
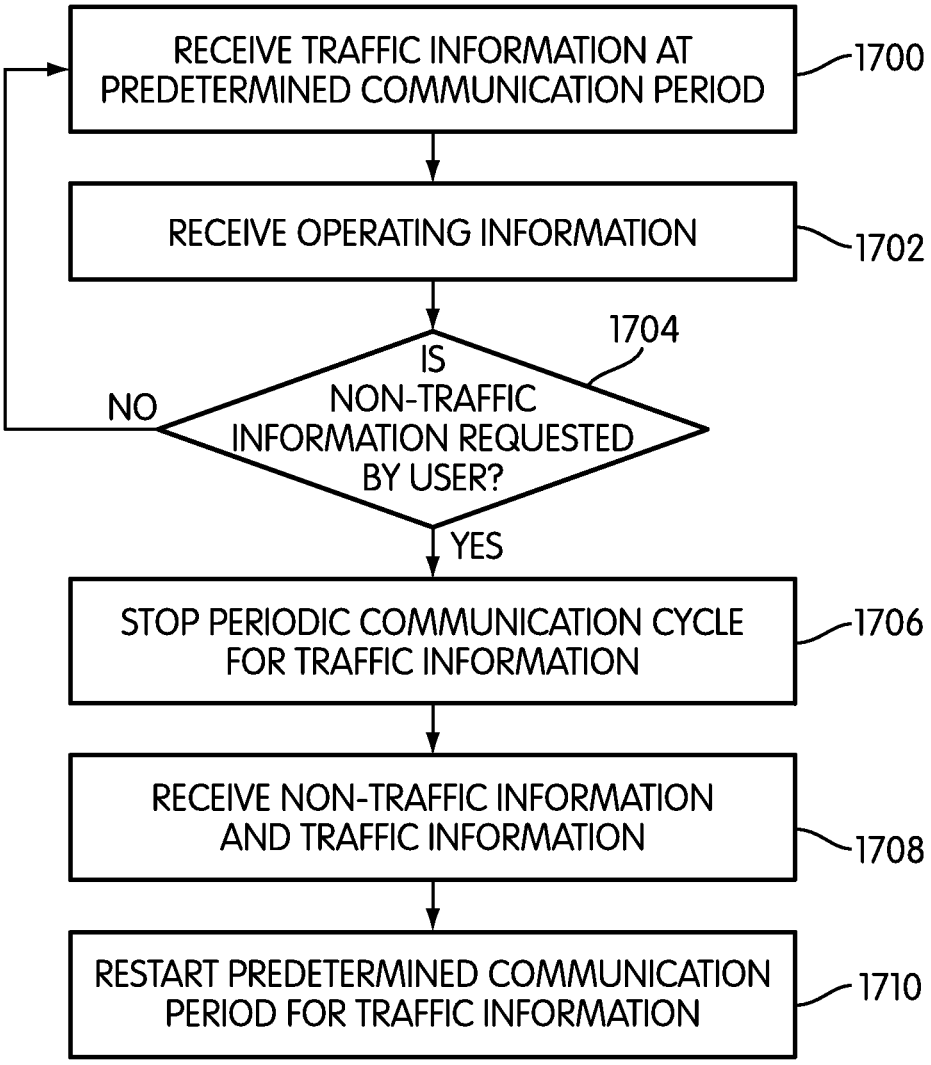
FIG. 17 is an embodiment of a process for managing communication with a service provider.

FIG. 17 illustrates an embodiment of a process system for updating various kinds of information. In the embodiment shown in FIG. 14, certain steps are associated with OBU 300 and certain steps are associated with service provider 200. In some embodiments, those steps associated with OBU 300 are performed on or by OBU 300 and those steps associated with service provider 200 are performed on or by service provider 200. However, this is not necessarily the case, and those steps associated with OBU 300 can be performed on or by service provider 200 or some other resource, and those steps associated with service provider 200 can be performed on or by OBU 300 or some other resource. It should also be understood that in some embodiments, one or more of the following steps could be optional. Still further, in other embodiments, additional steps could be added.

During step 1700, OBU 300 may request traffic information at a regular or predetermined communication period. The length of the communication period can have any value. In some cases, the length of the communication period can be fixed. In other cases, the length of the communication period can vary according to stored traffic information or sensed traffic information, as discussed in detail above.

During step 1702, OBU 300 receives operating information. The term "operating information" as used throughout this detailed description and in the claims refers to information related to any systems, devices or components useful in the operation of motor vehicle 100. Operation information can include information from OBU 300, or from one or more different systems, devices or components of motor vehicle 100. In some cases, operating information can include the type of information being requested from any system of motor vehicle 100, including any information requested by OBU 300. As an example, if a system of motor vehicle 100 is requesting weather information from a service provider, this information may be designated as operational information.

Following step 1702, during step 1704, OBU 300 may determine if any non-traffic information is being requested by a user or any system of motor vehicle 100. As an example, a user may request weather information by interacting with a touch screen of OBU 300. As another example, a user may request stock prices. As still another example, a user may request information related to one or more points of interest.

If, during step 1704, OBU 300 determines that no other information is being requested, OBU 300 may return back to step 1700 to continue requesting traffic information at a regular communication period. If, however, OBU 300 determines during step 1704 that another kind of information is being requested, OBU 300 may proceed to step 1706.

During step 1706, OBU 300 may stop the periodic communication cycle for receiving traffic information. Next, during step 1708, OBU 300 may receive the traffic information substantially simultaneously with the other, non-traffic information from service provider 200.

In step 1710, OBU 300 may restart the predetermined communication period for traffic information. For example, if the predetermined communication period is 15 minutes, OBU 300 may receive the next traffic update 15 minutes after the traffic and non-traffic information are received together. In other words, once the traffic and non-traffic information are received together, the time interval for receiving traffic information is reset.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. A method of receiving information for a motor vehicle, comprising the steps of:

receiving operating information about one or more systems of the motor vehicle at an electronic control unit in the motor vehicle;

the electronic control unit being configured to perform the steps of:

initiating a predetermined communication cycle with a service provider for periodically receiving a first type of information, the predetermined communication cycle being associated with requests for the first type of information that occur at a frequency defined by a first communication period;

determining an initial time from the first communication period at which the first type of information is scheduled to be received according to the predetermined communication cycle;

determining if a second type of information is being requested from the service provider, the second type of information being different from the first type of information, and wherein the second type of information is scheduled to be received at a second time that is substantially different from the initial time, wherein the second time is not associated with the first communication period;

preventing the first type of information from being received at the subsequent initial time according to the first communication period when the electronic control unit determines that the second type of information is being requested, thereby modifying the predetermined communication cycle; and receiving the first type of information together with the second type of information at the second time.

2. The method according to claim 1, wherein the first type of information is traffic information.

3. The method according to claim 2, wherein the second type of information is weather information.

4. The method according to claim 2, wherein the second type of information is point of interest information.

5. The method according to claim 2, wherein the second type of information is stock price information.

6. The method according to claim 1, wherein the step of receiving the first type of information together with the second type of information is followed by a step of resuming the predetermined communication cycle and receiving the first type of information at the frequency defined by the first communication period.

7. The method according to claim 1, wherein the second type of information is requested by a user.

8. A method of receiving information for a motor vehicle, comprising the steps of:

receiving operating information about one or more systems of the motor vehicle at an electronic control unit in the motor vehicle;

the electronic control unit being configured to perform the steps of:

initiating a predetermined communication cycle with a service provider for periodically receiving a first type of information, the predetermined communication cycle being associated with requests for the first type of information that occur at a frequency defined by a first communication period;

retrieving a first time corresponding to the end of the first communication period;

determining if a second type of information is being requested from the service provider, the second type of information being different from the first type of information, and wherein the second type of information is scheduled to be received at a second time that is substantially different from the first time, wherein the second time is not associated with the first communication period; and the method further comprising:

receiving the first type of information at the first time when the electronic control unit determines that the first type of information is the only type of information currently being requested; and receiving the first type of information at the second time when the electronic control unit determines that the second type of information is being requested from the service provider thereby receiving the first type of information together with the second type of information.

9. The method according to claim 8, wherein the first type of information is traffic information.

10. The method according to claim 8, wherein the first time occurs before the second time.

11. The method according to claim 8, wherein the first time occurs after the second time.

12. The method according to claim 8, wherein the second type of information is requested by a user of the motor vehicle.

13. The method according to claim 8, wherein the first communication cycle is determined according to stored traffic information associated with an onboard database.

14. The method according to claim 8, wherein the method limits the total instances of communication with the service provider in a given time period.

* * * * *